United States Patent [19]

Thalenfeld

[11] Patent Number: 4,474,351

[45] Date of Patent: Oct. 2, 1984

[54] MERCHANDISE DISPLAY HOOK AND BASE

[75] Inventor: David R. Thalenfeld, Beachurst, N.Y.

[73] Assignee: Trion Industries Inc., Wilkes-Barre, Pa.

[21] Appl. No.: 320,884

[22] Filed: Nov. 13, 1981

[51] Int. Cl.[3] ..... E04G 3/00

[52] U.S. Cl. ..... 248/220.4; 248/222.2

[58] Field of Search ..... 248/222.2, 220.3, 220.4, 248/221.1, 221.2; 211/59.1

[56] References Cited

U.S. PATENT DOCUMENTS

| | | | |
|---|---|---|---|
| 3,452,954 | 7/1969 | Lucietto et al. | 248/221.4 X |
| 3,976,201 | 8/1976 | Hodgson | 248/220.4 X |
| 4,027,799 | 6/1977 | Stucker | 248/220.3 X |
| 4,286,764 | 9/1981 | Pfeifer | 248/220.3 |
| 4,319,731 | 3/1982 | Pfeifer | 248/220.4 X |
| 4,351,440 | 9/1982 | Thalenfeld | 248/220.4 X |

*Primary Examiner*—J. Franklin Foss

*Attorney, Agent, or Firm*—Mandeville and Schweitzer

[57] ABSTRACT

The disclosure relates to a display device and assembly for apertured panel boards, etc., and particularly a multi-part assembly including a unitary, molded plastic multi-purpose base which, alone, constitutes one facet of the invention, and which is cooperatively combined with one or more especially adapted wire-like display elements for the support and/or display of merchandise. The molded plastic base member includes a forwardly opening vertical recess extending from top to bottom and cooperatively related to a straddling pair of cross-bar-engaging side members. Alongside the forwardly opening recess are upwardly opening sockets for the reception of vertical support sections of one or more wire-like display elements. The forwardly opening recess and bar engaging recesses cooperate to provide an advantageous support of a wire-like display element of a first type, while the associate vertical socket recesses are arranged to support wire-like elements of a second type. According to the invention, wire-like display elements may be incorporated with the multi-purpose base in a variety of combinations to great practical advantage to the retailer. Novel forms of wire-like display members are also disclosed.

12 Claims, 12 Drawing Figures

FIG. 2
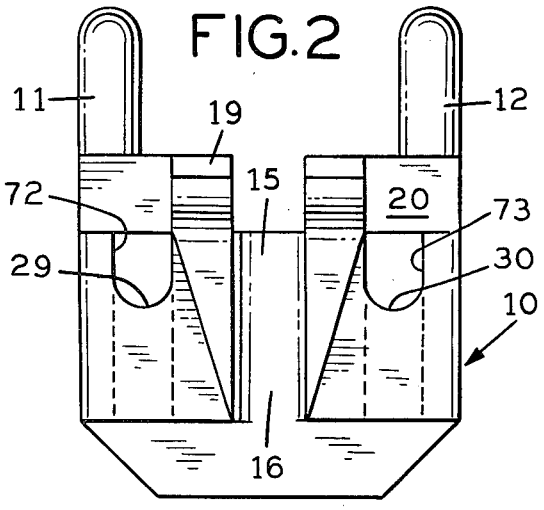
FIG. 3
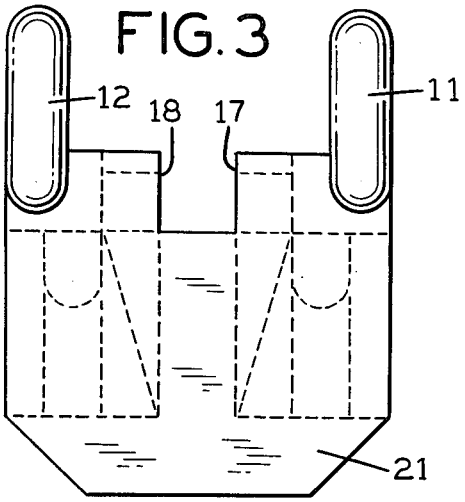
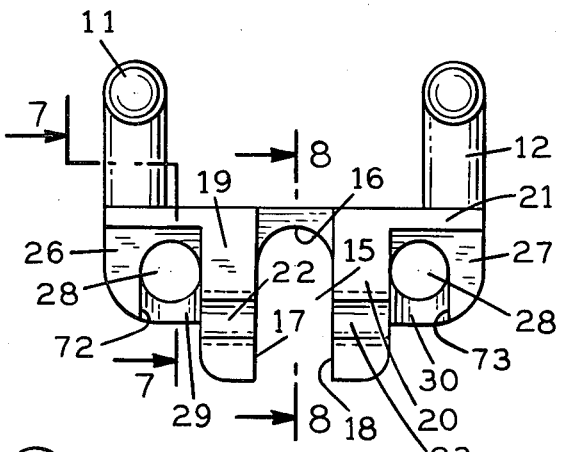
FIG. 4
FIG. 5
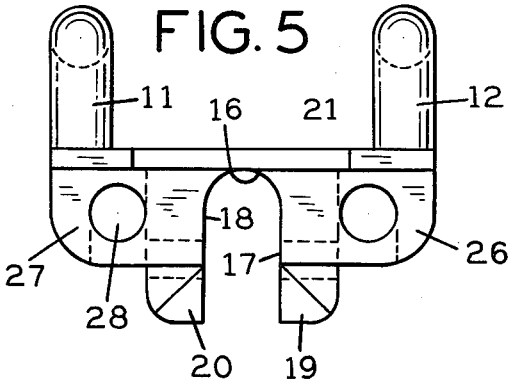
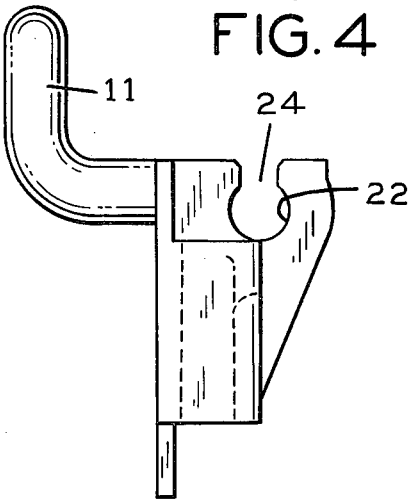
FIG. 6
FIG. 7
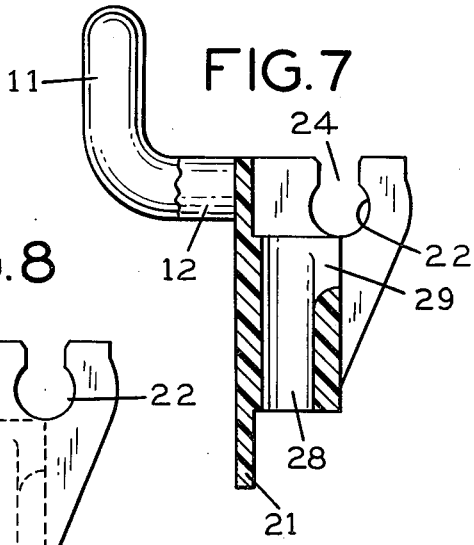
FIG. 8
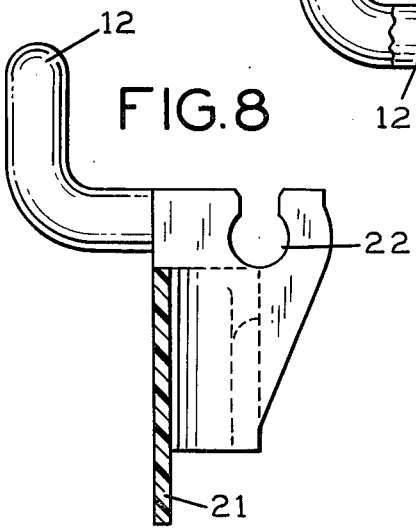

MERCHANDISE DISPLAY HOOK AND BASE

BACKGROUND AND SUMMARY OF THE INVENTION

In the point of purchase display and marketing of merchandise widespread use is made of apertured panel board displays. The panel boards are provided throughout with regularly spaced apertures, which receive L-shaped lugs of display hooks. The arrangement provides for great deal of flexibility in the arrangement and presentation of the display panel, because the display elements are removably received in the panel apertures, and may easily be moved from place to place and set up in any predetermined pattern. A variety of devices are available on the market for use as display hook devices, for mounting on apertured panel boards. Prominent among these devices is a class including a molded plastic base member, which may be assembled with a wire-like display hook element. Quite typically, the base member is installed in the apertured panel board by itself, and the wire-like display element is thereafter inserted in the base element. A particularly advantageous form of such two-part hook assembly is described and claimed in my copending application Ser. No. 303,419, filed Sept. 18, 1981 now U.S. Pat. No. 4,436,209. Other examples are reflected in the Lucietto U.S. Pat. No. 3,452,954, the Ginsburg et al. U.S. Pat. No. 3,985,325, and the Valiulis U.S. Pat. No. 3,912,084. The device of the present invention relates to this general class of devices, while incorporating significant improvements for the purposes intended.

One of the present strong trends in the point of purchase merchandising area is a trend toward the use of so-called Universal Product Code (bar code) labeling of products. Under this plan, each product is assigned a specific, computer-readable printed bar code. At the checkout counter, the product is moved past a scanning station by the checkout operator, causing the bar code to be read and processed. From the bar code, the checkout computer is able to determine and print the nature of the product and its price and, in many cases, to carry out certain inventory accounting functions.

In conjunction with the trend toward the use of Universal Product Codes, it frequently is important or desirable (and in some cases the subject of statutory requirements) to provide prominently displayed product identification and pricing in connection with the products, including those which are displayed as point of purchase items on a panel board display. This not only speeds up the checkout process but also expedites inventory taking and aids in assuming that the proper product is displayed on a particular hook. A particular advantageous form of merchandise display hook arrangement including provisions for Universal Product Code information is described and claimed in my copending application Ser. No. 151,357, filed May 19, 1980 (now U.S. Pat. No. 4,351,440).

While the desirability of Universal Product Code information is evident to many merchandisers, present laws frequently prohibit or restrict the use of such codes in many areas unless the merchandise packages are individually price-marked. Nevertheless, Universal Product Coding is becoming progressively more accepted throughout the country and it is both desirably and advantageous for merchandisers to prepare for the introduction of such techniques into their merchandising plans.

In accordance with the present invention, a uniquely adaptable merchandise display device is provided which is multi-purpose in its design, essentially at no increase in manufacturing cost, and which enables the point of purchase display merchandiser to utilize a wide variety of display elements. Of particular importance, it permits the merchandiser to utilize conventional forms of display hook elements initially, with the ability to merely add to the unit at a later date and capability of displaying Universal Product Code information.

Importantly, the device of the invention enables a large chain merchandiser, having outlets in many areas and subject to many statutory requirements, to purchase a common base and a variety of display elements for use in connection therewith. Where Universal Product Code identification is presently utilizable, it may be provided for initially, with a special, unitary, over-under style of display element, with the lower element carrying the product and the upper element carrying the bar code information. Where the initial use of bar code information is not feasible, or where special forms of product display hooks are required, such as loops, the base member accommodates the use of separate product code display elements and product display elements in a particularly unique and advantageous way.

For a more complete understanding of the above and other features and advantages of the invention, reference should be made to the following detailed description of preferred embodiments of the invention, and to the accompanying drawing.

DESCRIPTION OF THE DRAWING

FIGS. 2 and 3 are front and back elevational views respectively of a universal, multi-purpose molded base element for use in the assembly of FIG. 1.

FIGS. 4 and 5 are top and bottom plan views respectively of the base of FIGS. 2 and 3.

FIG. 6 is a side elevational view of the molded base of FIGS. 2 and 3.

FIGS. 7 and 8 are cross sectional view taken generally on lines 7—7, 8—8 respectively of FIG. 4.

DESCRIPTION OF PREFERRED EMBODIMENTS OF THE INVENTION

Figure 1:
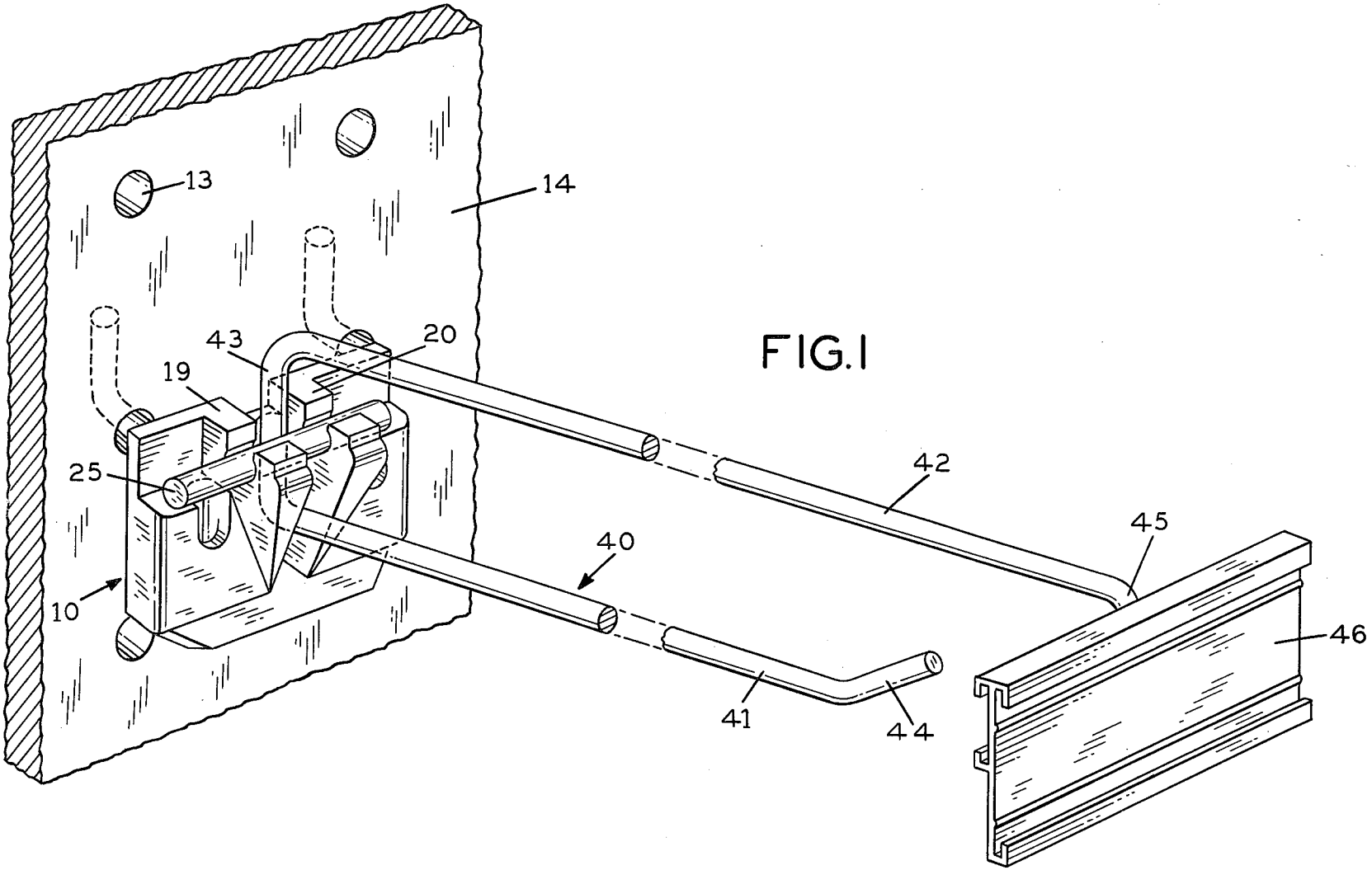
FIG. 1 is a perspective view of a panel board display assembly device according to the invention, arranged in an over-under configuration for the display of the product and of Universal Product Code information related thereto.

Referring now to the drawings, and initially to FIGS. 1–8, the reference numeral 10 designates in a general way a unitary, molded plastic base member, which is of multi-purpose design and forms a significant component element of the invention. As reflected more particularly in FIGS. 2–8, the base member 10 is provided at its upper back corners with a pair of generally L-shaped mounting lugs 11, 12. These are arranged in a known manner to be received in an adjacent pair of apertures 13 in a display panel board 14 (FIG. 1). Of course, the base may be designed for mounting in other ways than on an apertured panel board, but that is one of the most common means currently used in display arrangements.

In accordance with one aspect of the invention, the unitary base member 10 is provided with a forwardly opening vertical recess 15, which desirably is open at the top and bottom. The recess is defined by a generally semi-cylindrical back wall 16 and sidewalls 17, 18 formed by the spaced, opposed inner surfaces of vertically extending side rail members 19, 20 which are integral with and extend outwardly from the back wall 21 of the base member.

In the upper forward portions of the side rail members 19, 20, there are provided a pair of spaced crossbar-receiving recesses 22, 23. These are axially aligned and, as shown particularly in FIG. 4, spaced substantially forward of the back wall 16 of the recess. The recesses 22, 23 are open at the top, through somewhat reduced throat areas 24, so as to enable a wire-like crossbar element (see element 25 in FIG. 1) to be pressed downwardly through the throat 24 and into the recesses 22, 23, the crossbar typically being approximately the diameter of the recesses. In an advantageous form of the invention, the molded plastic base element 10 is formed of a structural plastic material such as that made available by the DuPont Company under its trademark "Delrin". This material has sufficient resilience to accommodate temporary displacement as the crossbar 25 is forced downwardly into the recesses 22, 23, as will be understood.

Along the outsides of the respective side rail members 19, 20 are socket-forming sections 26, 27, each provided with a vertical socket bore 28 for the reception of a wire display element, as will be described. The upper forward areas of the socket-forming sections 26, 27 are recessed, as at 29, 30 (see FIG. 2) to provide a guide pocket for laterally supporting a display element. As reflected in FIG. 4, the socket bores 28 advantageously are tangential to the outer walls of the side rail members 19, 20, so that the side rails themselves provide lateral support along one side.

As shown in FIG. 6, the socket-forming sections 26, 27 terminate below the bottom extremities of the crossbar recesses 22, 23, at least in the area directly below such recesses. This is to accommodate the reception in the recesses 22, 23 of a crossbar element which extends out beyond the walls of the side rails 19, 20 to a position at least partly overlying the recesses 29, 30. This is reflected in the perspective views of FIGS. 1 and 12, for example.

A particularly advantageous form of the invention is illustrated in FIG. 1, in which the multi-purpose base member is assembled and combined with an over-under display element having provisions for the support of display products, as well as Universal Product Code information. To this end, the display element 40 of FIG. 1 advantageously may be of a type covered by the Karmin U.S. Pat. No. 3,374,898, being provided with a lower, product supporting element 41 and an upper combined display and guard element 42. In the illustrated arrangement, an elongated, U-shaped wire-like element is bent to form the upper and lower wire sections 42, 41, connected at their inner ends by an integral, vertical support section 43. At its outer extremity, the product supporting element 41 has an upwardly bent end portion 44. The upper section 42, at its outer extremity, has a downwardly curved section 45, which mounts a code label holder 46. To great advantage, the construction and mounting of the code label holder 46 may be in accordance with the disclosures of my copending U.S. application Ser. No. 151,357 (now U.S. Pat. No. 4,351,440), although such construction and mounting is not a critical part of the present invention.

Rigidly secured to the base section 43 of the wire-like display element is a short crossbar member 25, this typically being secured by the welding. As reflected in FIG. 1, the crossbar 25 is attached to the base member 43 well above the lower extremity 47 of the base section. Accordingly, when the display element 40 is assembled with the plastic base 10, by pressing the crossbar 25 into the spaced recesses 22, 23, the vertically disposed wire support section 43 extends downward within the forwardly opening recess 15 of the base member, passing behind and below the crossbar 25 to which it is rigidly secured. The lower extremity 47 of the support section 43 bears against the lower portions of the recess back wall 16, such that the entire display unit is supported firmly in its display position, as shown in FIG. 1.

The illustrated mounting of the display element 40 shown in FIG. 1, by means of the rigid crossbar 25, is an extremely stable arrangement, because the crossbar is lockingly engaged by the recessed side rails 19, 20 at rather widely spaced areas, providing great lateral stability. Vertical stability is provided by reason of the downward extension of the stabilizing portion 43 below the level of the crossbar 25, where it bears against the back of the forwardly opening recess.

Figure 9:
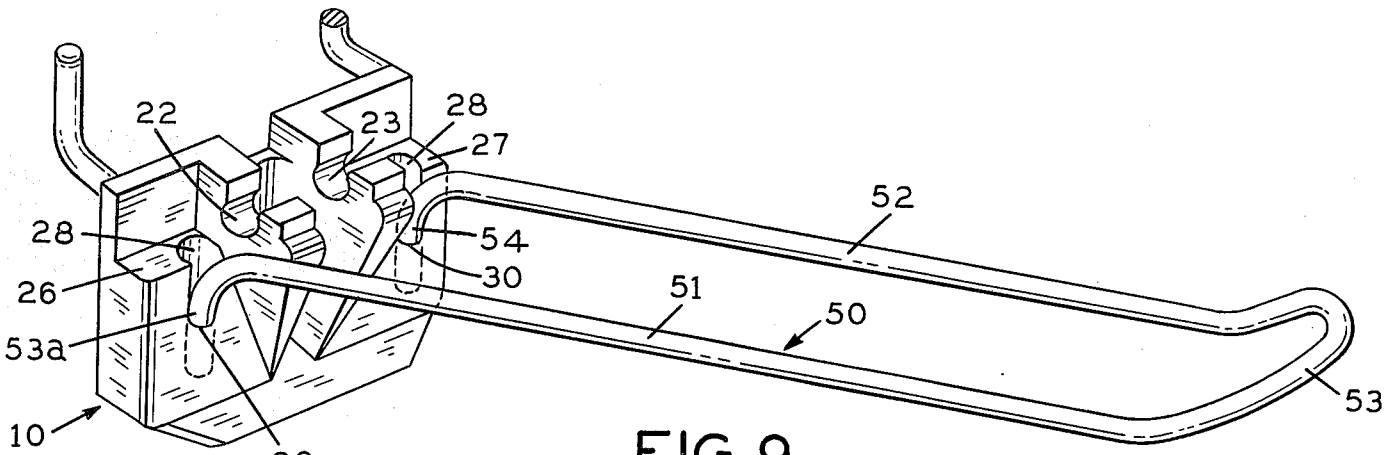
FIG. 9 is a perspective view of an assembly according to the invention, in which the base member supports a loop-type wire product display element.
Figure 10:
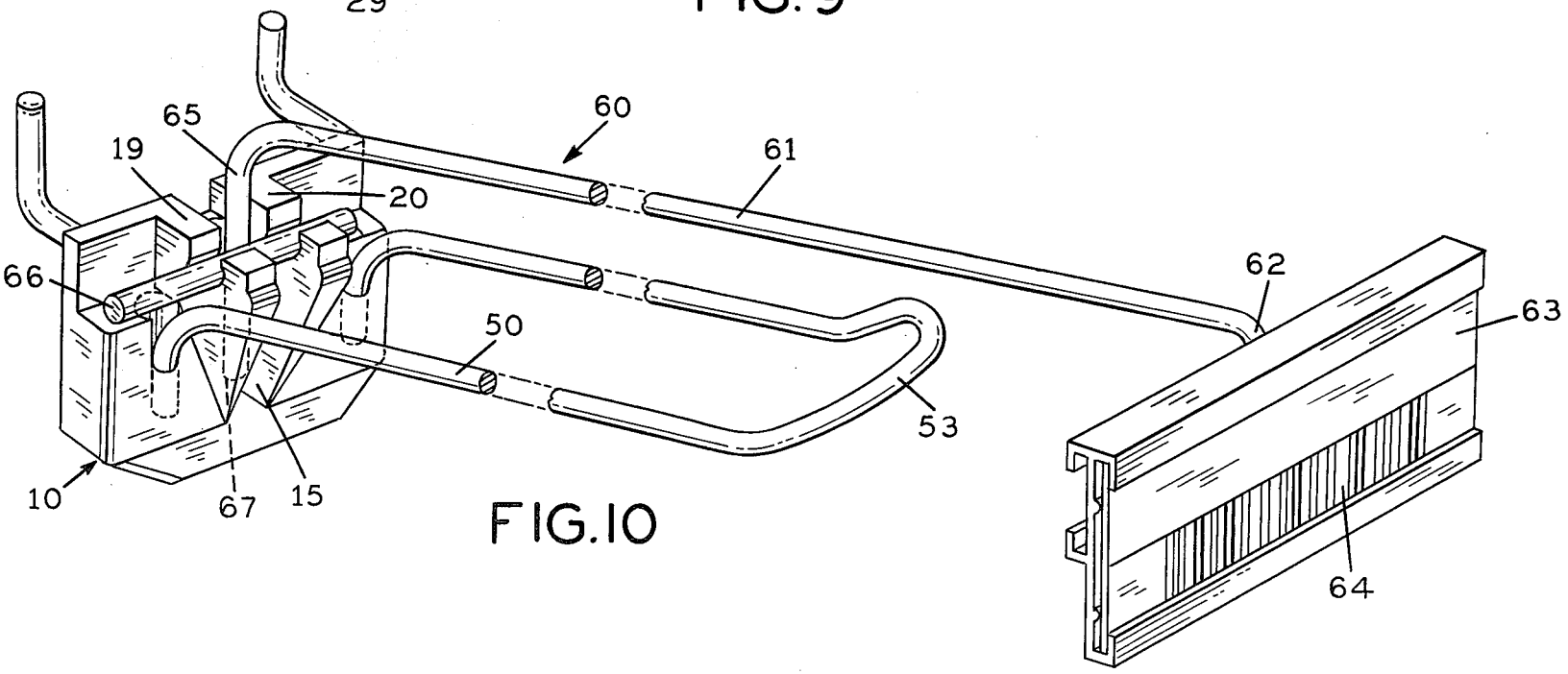
FIG. 10 is a perspective view similar to FIG. 9, showing an additional wire-like display element mounted on the multi-purpose base for the display of Universal Product Code information in connection with the use of the loop-type product display element.

In FIGS. 9 and 10, alternate forms of the invention are illustrated, which demonstrate the versatility of the multi-function system. Thus, in FIG. 9, the base member 10 is shown assembled with a conventional loop-type display hook 50. The loop hook 50 has a pair of forwardly extending product support elements 51, 52 joined at the outer end by an upturned loop section 53. At their inner ends, the wire sections 51, 52 have downturned support sections 53, 54 respectively, which are received in the vertical sockets 28 in the socket-forming sections 26, 27. The forwardly opening recesses 29, 30 of the sockets 28 enable the support sections 53, 54 to be inserted sufficiently into the sockets 28 such that the upper extremities of the wire elements 50 are at least slightly below the level of the crossbar receiving recesses 22, 23. In the illustration of FIG. 9, however, there is no crossbar position in the recesses 22, 23 as will be evident. As one of the advantageous aspects of the invention, the multi-purpose base member 10 may be utilized in the manner illustrated in FIG. 9, with an entirely conventional type of loop hook 50, for use in applications where it is not desired to provide Universal Product Coding or other pricing information.

As shown in FIG. 10, however, if it is desired initially to utilize product code information with the loop hook device 50, or if it later becomes permissible or desirable to do so, the assembly of the invention accommodates the separate installation of a label holding element. To this end, the label holding element 60 includes an elongated, forwardly extending wire arm 61 having a downwardly curved forward portion 62 mounting a product code label holder 63, illustrated in FIG. 10 as mounting a Universal Product Code label 64. Typically, other, non-coded information is included on the label, such as a description of the product together with its price and unit pricing.

At its inner end, the display element 60 is bent downwardly, to form a vertically extending support section 65, to which is welded or otherwise fixidly secured a horizontal crossbar element 66. The vertical support element 65 extends well below the crossbar 66 and terminates near or below the lower portions of the forwardly opening recess 15, as reflected at 67 in FIG. 10. As shown in FIG. 10, the support section 65 passes behind the crossbar 66 so as to bear forwardly against the bar when installed in the manner indicated. The crossbar 66 may be similar to the crossbar 25 of FIG. 1, being basically of the same diameter as the recesses 22, 23, and being snapped lockingly into place through the narrower throat area 24 of the plastic base member. When thus installed, the outer ends of the crossbar overlie the inner end portions of the wire display element 50, providing not only a desirably compact arrangement but also hindering unauthorized removal of the display element 50.

Figure 11:
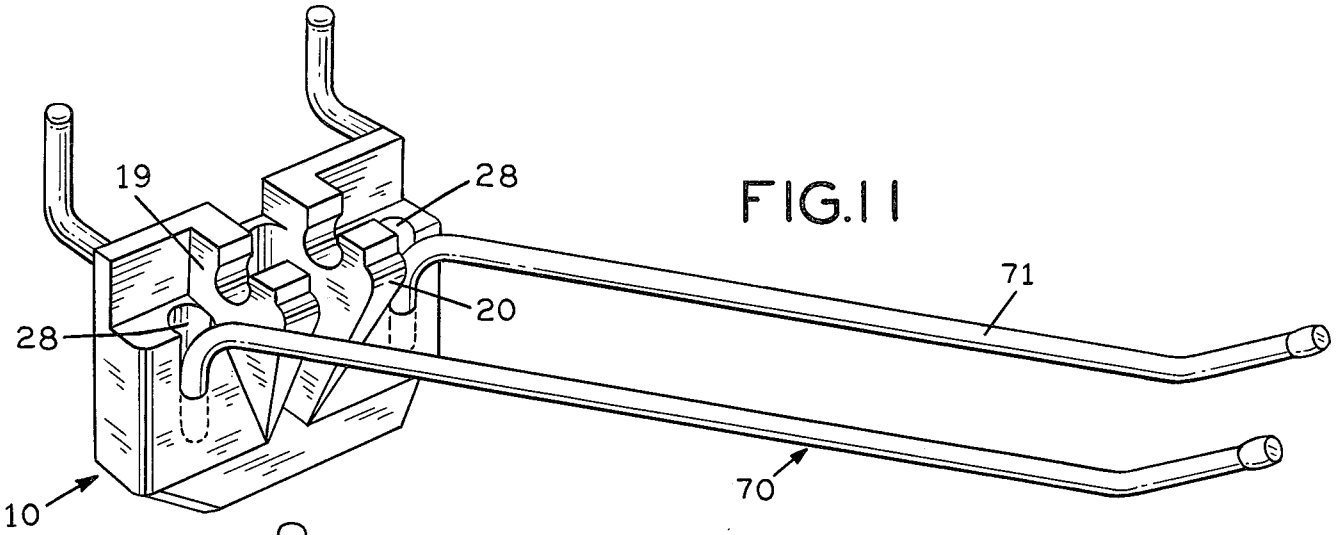
FIG. 11 is a perspective view illustrating the use of the multi-purpose base element for the support of a pair of conventional, wire-like merchandise display elements.
Figure 12:
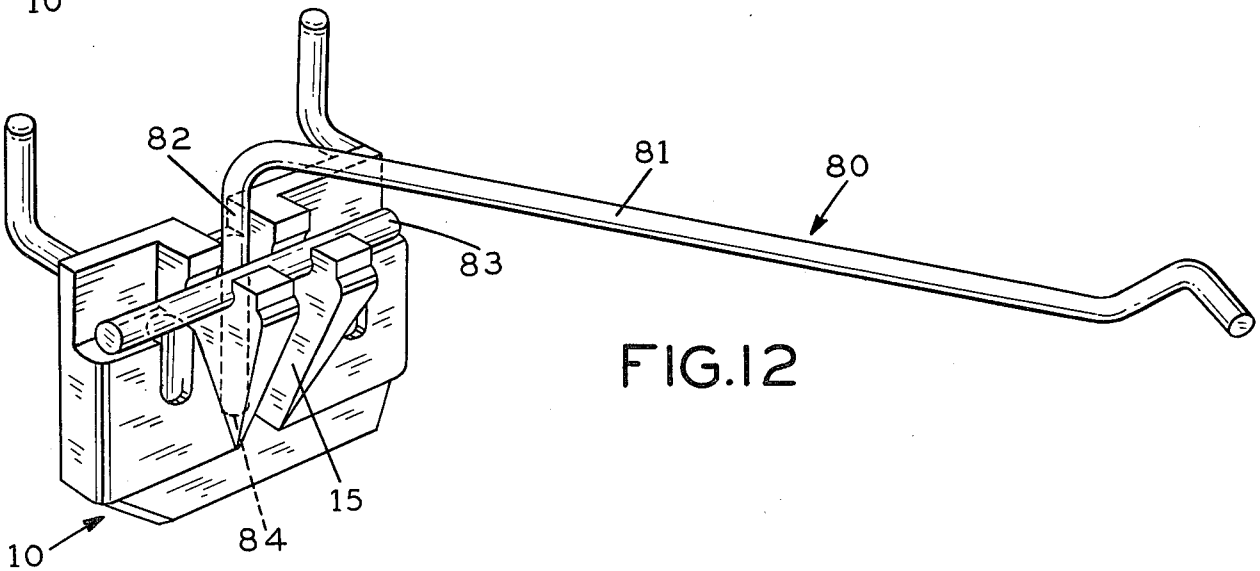
FIG. 12 is a perspective view illustrating a special form of single-wire display element which is mounted and stabilized in the multi-purpose base member by means of a welded cross bar element.

FIGS. 11 and 12 provide illustrations of still further advantageous assemblies utilizing the multi-function base element 10. FIG. 11, the base element receives in its laterally spaced sockets 28 a pair of conventional, single wire display elements 70, 71. These are laterally stabilized in the sockets 28, by bearing directly against the outer surfaces of the respective side rail members 19, 20, and also by bearing outwardly against the outer sidewalls 72, 73 (see FIGS. 2, 4) of the recesses 29, 30 (the legs 51, 52 of the loop device of FIGS. 9, 10 are similarly stabilized by this geometrical arrangement of the base). The display element 70, 71 may be used singly or in pairs, as illustrated in FIG. 11, use in pairs being advantageous for display of certain kinds of articles, such as hammers, for example.

In the illustration of FIG. 12, an advantageous form of single wire element 80 is shown, which has an elongated forwardly extending wire section 81 joining with a vertical support section 82 received in the forwardly opening recess 15 of the base member 10. The support section 82 has rigidly welded to it a transversely disposed crossbar 83, which is tightly received in the recesses 22, 23, as described in connection with the other embodiments. The lower end 84 of the support section extends well below the crossbar, and bears rearwardly against the rear walls 16 of the recess 15. As heretofore described, the arrangement of FIG. 12 provides for exceptional lateral stability of the display element 80, because of the support engagement of the crossbar 83 at rather widely spaced points in the base member 10.

As is evident in FIG. 4, for example, in any of the forms of the new assembly in which a display element is mounted by means of a crossbar received in the side rail members 19, 20, a superior structural arrangement is provided, not only because of the improved lateral stability of the display element, but also because the loading on the plastic base is displaced outwardly from the center and more toward the location of the mounting lugs 11, 12. A base of a given size and strengh is thus much less susceptible to sagging and bowing in the center, with a resulting tendency of plastic creep into a bowed or sagged position, as sometimes is experienced with more conventional plastic base designs.

Of particular significance to the present invention is the exteme versatility of the assembly, particularly the base element 10, which enables a purchaser to procure a single base element for a multiplicity of uses with different individual display elements or various combinations of display elements, and particularly with regard to the present or future installation of Universal Product Code or similar facilities in conjunction with the merchandise display.

Importantly, by providing in a single base a multiplicity of related and cooperative functions, it becomes both possible and practical to provide for optimized sizing of product molds, enabling significant reductions in manufacturing cost to be realized. Thus, by reason of the unique design of the base member, it is possible to achieve multiple utilizations thereof, either individually or simultaneously with different types of display elements. As contrasted to plastic base elements of conventional design, requiring individually designed elements for different end uses, the cost savings per unit can be significant, because of the ability to operate with large production runs and fewer mold requirements.

A uniquely advantageous feature of the new display hook assembly is the provision of a novel form of display element incorporating a rigid, transverse crossbar, in conjunction with a vertically disposed support element, for mounting and support of the wire-like display device. The transverse crossbar element is arranged to be tightly received in spaced, upwardly opening recesses provided in the molded base member, providing for exceptional lateral stability of the display element. The arrangement also easily accommodates a single, U-shaped display element having over-and-under configuration of wire elements for product support and code information display. At the same time, the arrangement fully accommodates the use of a separate wire element, of L-shaped configuration with a transverse crossbar, for intallation of product coding capability either at a separate time from the initial installation of the unit, or in conjunction with a special configuration of display device, such as a two-section loop ( FIG. 10).

Moreover, the assembly accommodates the use of the crossbar mounting for a single, L-shaped, display element, as shown in FIG. 12, without regard to product coding. An exceptionally strong and stable mounting of the wire-like display element is provided.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A unitary multi-purpose base for a panel board display hook or the like, of unitary molded plastic construction and having (a) a main body portion, (b) means for mounting said body portion on a display structure, (c) said body having a central forwardly opening recess therein extending vertically from top to bottom, a pair of crossbar-engaging side rails positioned one on each side of said forwardly opening recess, (e) each said side rail having an opensided crossbar-engaging recess, (f) a pair of spaced, vertically oriented socket-forming portions extending on opposite sides of said forwardly opening recess, (g) said socket-forming portions each having a vertical socket provided with an open upper end for the reception of a wire-like display element or the like, (h) said crossbar-engaging recesses being mounted generally above the open upper ends of said sockets.

2. A display assembly comprising a unitary base member of the type set forth in claim 1, in combination with (a) an elongated, wire-like display element, (b) said display element having a short, generally vertical support section and an elongated forwardly extending section, (c) a horizontal crossbar secured mechanically to said support section, (d) said crossbar being removably secured in said crossbar engaging recesses, (e) said vertical support section being received in said forwardly opening recess and bearing rearwardly against lower portions thereof.

3. A display assembly according to claim 2, further characterized by (a) the forwardly extending section of said display element being integrally joined with the upper end of said support section, (b) a second forwardly extending section of said display element being integrally joined with the lower end of said support section.

4. A display assembly according to claim 3, further characterized by (a) the upper one of said forwardly etending section mounting at its forward etremity a code label support, (b) the lower one of said forwardly extending sections being shorter than the upper one and having its forward end extremity located generally behind said label support.

5. A display assembly comprising a unitary base member of the type set forth in claim 1, further characterized by (a) a loop-type wire-like display element having downwardly extending inner end portions received in said sockets, (b) a wire-like label supporting element having a fowardly extending portion mounting a label holder at its outer end, and a downwardly extending support portion at its inner end, (c) said support portion being received in said forwardly opening recess, (d) a transverse crossbar element rigidly secured to said support portion above its lower end, (e) said crossbar element being lockingly received in said open-sided crossbar-receiving recesses.

6. For use in combination with a wire-like display member of the general type having a forwardly extending element, a vertical support element, and a transverse crossbar element fixed to said support element, a unitary molded plastic base element comprising (a) a main body portion, (b) mounting means for securing said base element to a display structure, (c) said body portion having a vertically oriented, forwardly opening recess adapted for the reception of the vertical support element of a display member, (d) said body having a pair of integral side members on opposite sides of said forwardly opening recess, (e) each of said side members having an open-sided crossbar receiving recess for snap-in reception and retention of the crossbar of a display member, (f) said crossbar receiving recesses being located adjacent the upper, forward portion of said forwardly opening recess.

7. A base element according to claim 6, further characterized by (a) the sides of said forwardly opening recess being defined in part by said side members.

8. In combination with a base member of the general type having a forwardly facing vertical recess and a pair of spaced, laterally opening, snap-in type crossbar receiving recesses on opposite sides of said forwardly facing recess, a wire-like display element comprising (a) a forwardly extending section of wire-like material, (b) a downwardly extending wire-like section integrally formed with the inner end of said forwardly extending section and adapted for reception in and support by the forwardly facing recess of a base member, and (c) a rigid wire-like crossbar fixed to said downwardly extending section and disposed transversely with respect thereto, (d) said crossbar being positioned substantially above the lower end of said downwardly extending portion, (e) said crossbar extending on opposite sides of said downardly extending portion and being removably lockingly receivable in the space laterally opening recesses of said base member.

9. A display element according to claim 8, further characterized by (a) said crossbar being fixed to said downwardly extending portion on the front side thereof.

10. A display element according to claim 8, further characterized by (a) said forwardly extending section having a downturned outer end, and (b) a label holder mounted at said outer end for displaying bar code information or the like.

11. A display element according to claim 10, further characterized by (a) a second forwardly extending portion being joined integrally with the lower end of said downwardly extending portion, (b) said second forwardly extending portion serving as a support for the display of merchandise.

12. For use in combination with a wire-like display member of the general type having a forwardly extending element, a vertical support element, and a transverse crossbar element fixed to said support element, a unitary molded plastic base element comprising (a) a main body portion, (b) mounting means for securing said base element to a display structure, (c) said body portion having a vertically oriented, forwardly opening recess adapted for the reception of the support element of a display member, (d) said body having a pair of integral side members on opposite sides of said forwardly opening recess, (e) said side members having open-sided crossbar receiving recesses for locking retaining the crossbar of a display member, (f) said crossbar receiving recesses being located adjacent the upper, forward portion of said forwardly opening recess, (g) socket-forming members integrally formed on said base element adjacent and outside of said side members, (h) said socket-forming members each having a generally vertical socket therein for the reception of a portion of a wire-like display element.

* * * * *